US012011069B2

(12) United States Patent
Eitniear

(10) Patent No.: US 12,011,069 B2
(45) Date of Patent: Jun. 18, 2024

(54) ARTICLES MADE FROM ORGANIC FIBER TWINE AND METHODS FOR MAKING SAME

(71) Applicant: Necknotz L.L.C., Fayetteville, NC (US)

(72) Inventor: Lindsey Rae Eitniear, Fayetteville, NC (US)

(73) Assignee: NECKNOTZ L.L.C., Fayetteville, NC (US)

( * ) Notice: Subject to any disclaimer, the term of this patent is extended or adjusted under 35 U.S.C. 154(b) by 319 days.

(21) Appl. No.: 17/504,468

(22) Filed: Oct. 18, 2021

(65) Prior Publication Data

US 2022/0125167 A1 Apr. 28, 2022

Related U.S. Application Data

(60) Provisional application No. 63/104,997, filed on Oct. 23, 2020.

(51) Int. Cl.

| | |
|---|---|
| ***A44C 11/00*** | (2006.01) |
| ***A44C 5/00*** | (2006.01) |
| ***A44C 27/00*** | (2006.01) |
| ***D02G 3/04*** | (2006.01) |
| ***D02G 3/36*** | (2006.01) |
| ***D02G 3/44*** | (2006.01) |

(52) U.S. Cl.

CPC ..... *A44C 11/00* (2013.01); *A44C 27/00* (2013.01); *D02G 3/04* (2013.01); *D02G 3/36* (2013.01); *D02G 3/44* (2013.01); *D10B 2101/20* (2013.01); *D10B 2201/01* (2013.01)

(58) Field of Classification Search

CPC ..... Y10T 29/4959; Y10T 29/49451; Y10T 29/49597; A44C 11/00; A44C 27/00; A44C 15/005; A44C 5/00; A44C 5/0053; A44C 5/185; A44C 5/20; A44C 5/2019; A44C 5/2033; A44C 5/2038

USPC ..... 59/78, 80, 83; 132/53, 56; 29/896.41, 29/896.411

See application file for complete search history.

(56) References Cited

U.S. PATENT DOCUMENTS

| | | | | |
|---|---|---|---|---|
| 2,036,172 A * | 3/1936 | Gagnon | ..... | A44C 5/185 24/116 A |
| 5,713,218 A * | 2/1998 | McCabe | ..... | A44C 5/0053 63/3.1 |
| 2005/0241335 A1* | 11/2005 | Scharr | ..... | A44C 5/185 63/3.1 |

FOREIGN PATENT DOCUMENTS

| | | | |
|---|---|---|---|
| CH | 138955 A | * | 3/1930 |
| CH | 251471 A | * | 10/1947 |
| CH | 274947 A | * | 4/1951 |

(Continued)

OTHER PUBLICATIONS

Statement of Lindsey Eitniear, pp. 1-3 (Oct. 15, 2021).

*Primary Examiner* — Jack W Lavinder

(74) *Attorney, Agent, or Firm* — Jenkins, Taylor & Hunt, P.A.

(57) ABSTRACT

An ornamental article includes a single piece of metal wire. The ornamental article includes a single piece of organic fiber twine knotted around the metal wire to produce an elongate member with first and second ends. The ornamental article further include at least one crimp connector located on at least one of the first and second ends. The ornamental article further includes a clasp located on one of the first and second ends for connecting to the other of the first and second ends.

18 Claims, 18 Drawing Sheets

(56) References Cited

FOREIGN PATENT DOCUMENTS

FR 1015372 A * 9/1952

* cited by examiner

ARTICLES MADE FROM ORGANIC FIBER TWINE AND METHODS FOR MAKING SAME

PRIORITY CLAIM

This application claims the priority benefit of U.S. Provisional Patent Application Ser. No. 62/104,997, filed Oct. 23, 2020, the disclosure of which is incorporated herein by reference in its entirety.

TECHNICAL FIELD

The subject matter described herein relates to ornamental articles, such as necklaces and bracelets, made from organic fiber twine and methods for making such articles.

BACKGROUND

Organic fiber twine, such as hemp twine, is often used to make ornamental articles, such as bracelets and necklaces. One problem with existing hemp fiber ornamental articles is that the ornamental articles lack durability and or are difficult to manufacture. For example, one type of ornamental article made using hemp fiber twine involves knotting four strands of hemp twine together to form a bracelet or a necklace without any supporting material. The thickness of four strands of hemp fiber makes it difficult to incorporate beads or other features into the necklace or bracelet without knotting the strands around beads. In addition, the lack of supporting structure makes the ornamental articles lack durability. For example, the lack of a supporting wire or other structure can cause hemp jewelry to unravel or separate from the clasp.

Some hemp jewelry includes two wires and two strands of hemp fiber. Using two wires and two strands of fiber provides better durability than jewelry without wires. However, the combined thicknesses of the wires and the strands makes incorporation of some types of beads or other objects difficult. In addition, single crimp connectors used on the ends of such jewelry often fail.

In light of these difficulties, there is exists a need for improved ornamental articles made from organic fiber twine and methods for manufacturing same.

SUMMARY

An ornamental article includes a single piece of metal wire. The ornamental article includes a single piece of organic fiber twine knotted around the metal wire to produce an elongate member with first and second ends. The ornamental article further include at least one crimp connector located on at least one of the first and second ends. The ornamental article further includes a clasp located on one of the first and second ends for connecting to the other of the first and second ends.

BRIEF DESCRIPTION OF THE DRAWINGS

The subject matter described herein will now be explained with reference to the accompanying drawings of which.

DETAILED DESCRIPTION

Figure 1:
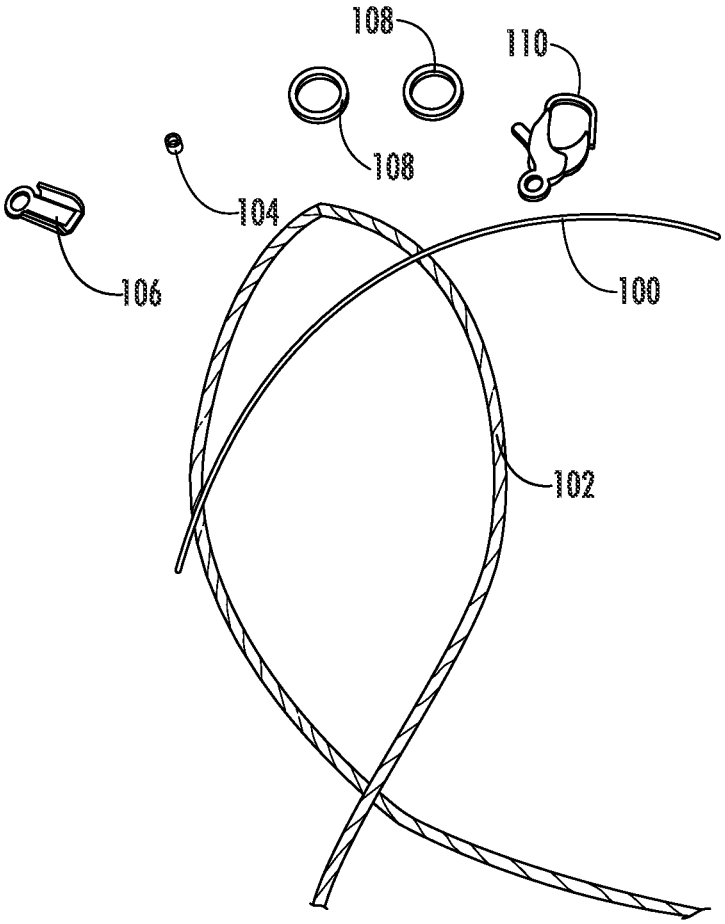
FIG. 1 is an image illustrating exemplary materials for making ornamental articles from organic fiber twine.

As described above, ornamental articles from organic twine material are either difficult to manufacture or lack durability. The subject matter described herein utilizes a metal wire, which in one example is a single piece of braided bead wire and knots the organic twine material around the bead wire. Instead of incorporating a single crimp connector on each end, the subject matter described herein includes the incorporation of two crimp connectors around the metal wire on each end. One crimp connector is a small crimp connector that crimps around the metal wire only. An example of this type of connector is a bead or sleeve connector. Another type of crimp connector is crimped around the small crimp connector. In one example, the second or larger crimp connector is a fold-over connector that connects not only around the wire but also around a fold of the organic twine material and the smaller crimp connector FIG. 1 illustrates exemplary materials for manufacturing an ornamental article from organic twine material. In FIG. 1, the materials include a single piece of metal wire 100 and a single piece of organic twine 102. In one example, metal wire 100 comprises braided bead wire and organic twine 102 comprises hemp twine. Also illustrated in FIG. 1 are sleeve crimp connector 104, a fold-over crimp connector 106, jump rings 108 and a clasp 110, which in the illustrated example is a lobster clasp.

Figure 2:
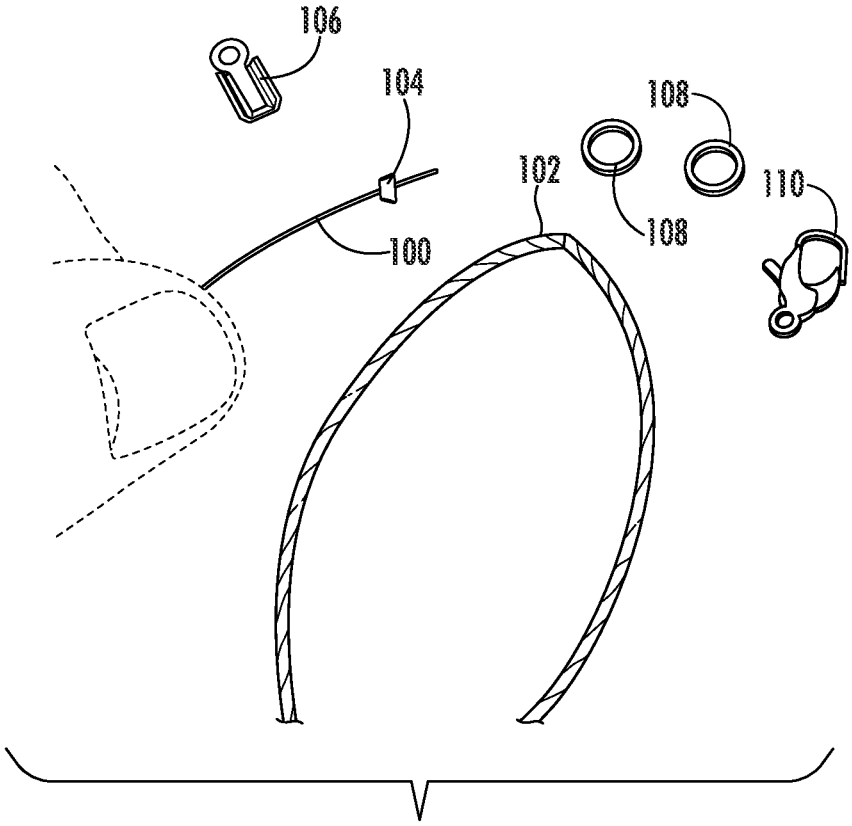
FIG. 2 is an image illustrating the incorporation of a crimp connector on one end of a metal wire used to make an ornamental article from organic fiber twine.

FIG. 2 illustrates the incorporation of the sleeve crimp connector 104 in FIG. 1 on one end of metal wire 100. In FIG. 2, sleeve crimp connector 104 is crimped around metal wire 100 near the end of metal wire 100. As indicated above, in an alternate implementation, a sleeve crimp connector may be used.

Figure 3:
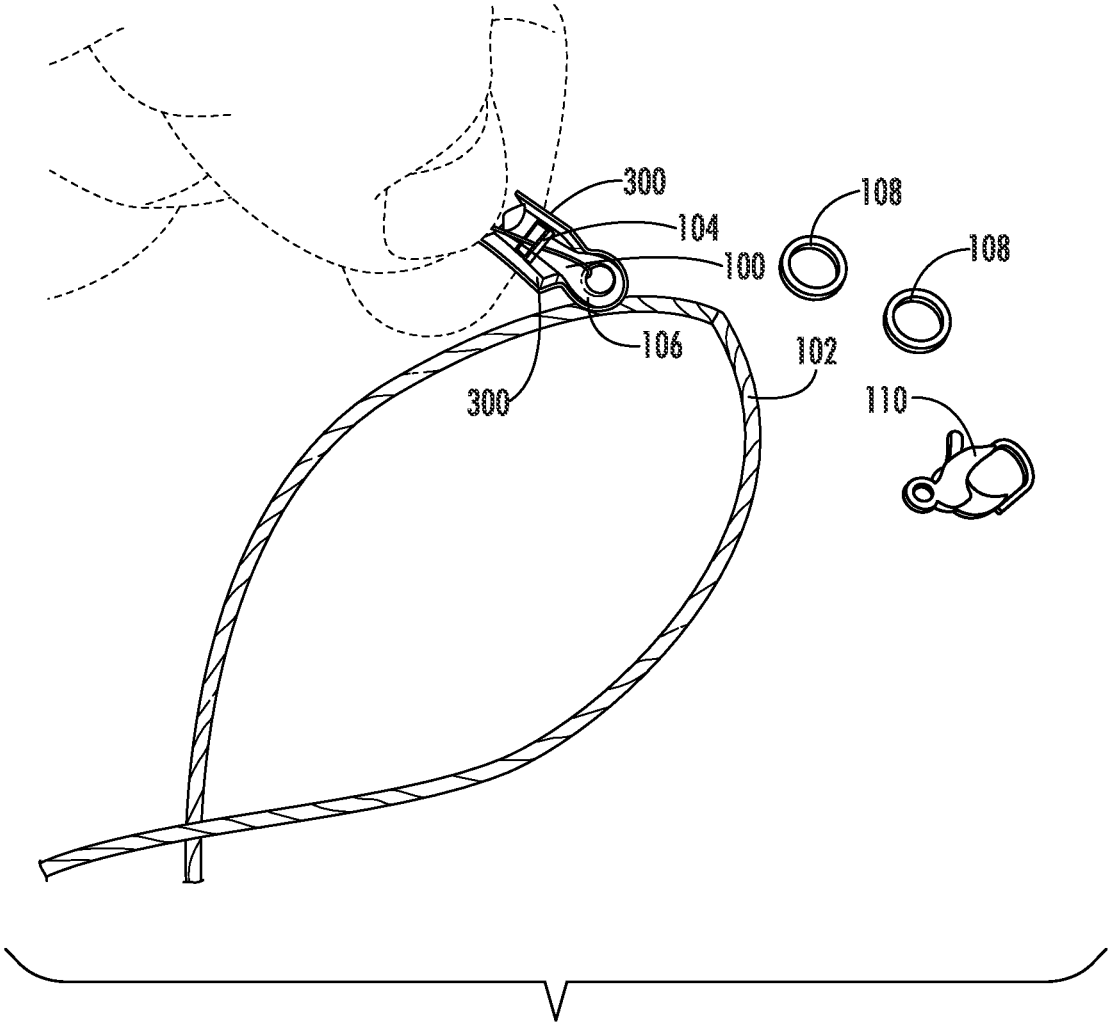
FIG. 3 illustrates the incorporation of a second crimp connector around the first crimp connector on a metal wire for making an ornamental article from organic fiber twine.

FIG. 3 illustrates the incorporation of fold-over crimp connector 106 around sleeve crimp connector 104. In FIG. 3, sleeve crimp connector 104 is crimped around wire 100. Sleeve crimp connector 104 is inserted between folds 300 of fold-over crimp connector 106. The use of one crimp connector to crimp around and enclose another crimp connector produces a more secure connection at the end of the ornamental article for connection to a clasp, as will be described in more detail below.

Figure 4:
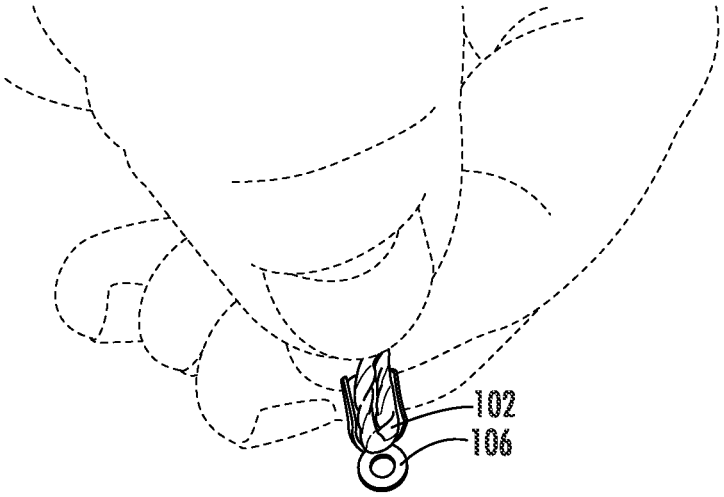
FIG. 4 is an image illustrating the incorporation of a loop of hemp fiber in the crimp connector of FIG. 3.

In FIG. 4, the organic twine material is folded to form a loop and inserted into fold-over crimp connector 106. Thus, in FIG. 4, fold-over crimp connector 106 includes wire 100 with sleeve crimp connector 104 crimped around wire 100 and the loop of organic twine material 102.

Figure 5:
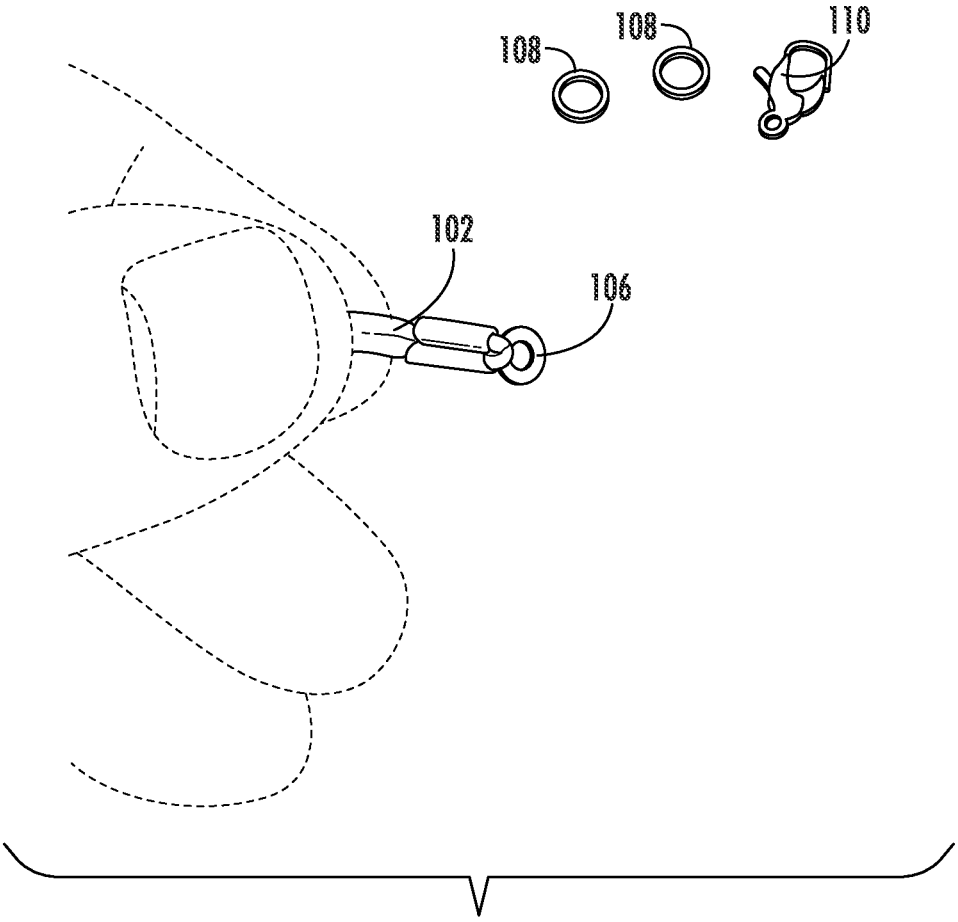
FIG. 5 is an image illustrating the crimp connector of FIG. 3 after crimping the hemp fiber and a jump ring into one end of an ornamental article made from hemp fiber twine.

FIG. 5 illustrates the results of crimping fold-over crimp connector 106 in FIG. 4 around the loop of organic twine material 102, the sleeve crimp connector (not visible in FIG. 5), and the wire (not visible in FIG. 5). The result of using one crimp connector of one type to enclose a smaller crimp connector of a different type is a more secure connection that using a single crimp connector at the ends of the ornamental article.

Figure 6:
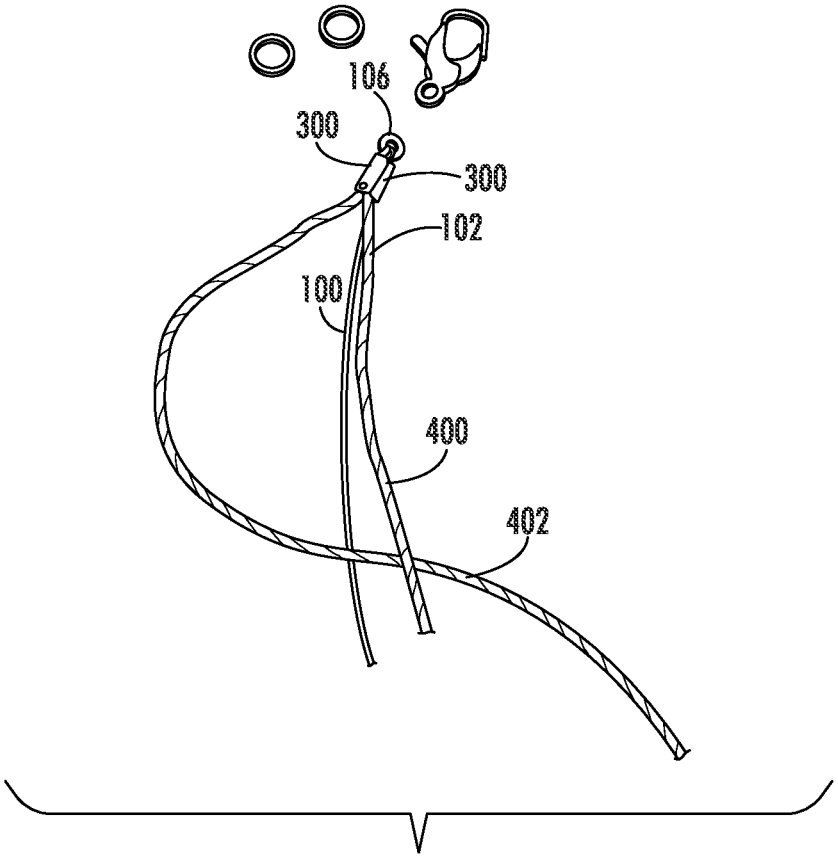
FIG. 6 is an image illustrating a first step in the knotting process of knotting two ends of a piece of hemp fiber around a metal wire to form an ornamental article.

FIG. 6 illustrates the first step the process of knotting organic twine 102 around metal wire 100. In FIG. 6, the two ends 400 and 402 of organic twine 102 are crossed over each other to form a loop and metal wire 100 is located on one side of the loop. FIG. 6 also illustrates folds 300 of fold-over crimp connector 106 surrounding a loop of twine 102 and wire 100. Sleeve crimp connector 104 is not visible in FIG. 6, but sleeve crimp connector 104 is also crimped within folds 300 of fold-over crimp connector 106.

Figure 7:
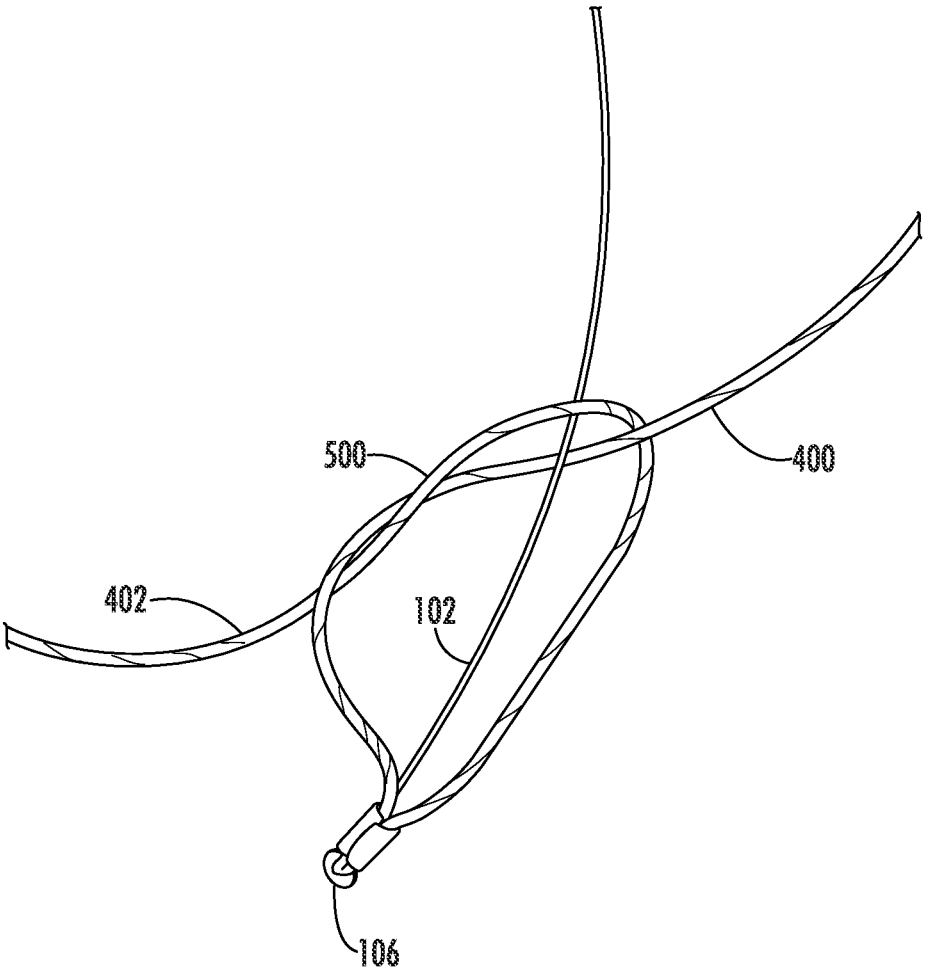
FIG. 7 is an image illustrating a second step in knotting the hemp fiber around the single metallic wire.

FIG. 6 illustrates the second step in the process of knotting twine 102 around metal wire 100. In FIG. 7, end 400 of organic twine 102 is passed under twine 102 and over twine 402. End 402 is passed over wire 100 and through the loop formed by passing end 400 under wire 100 to form a knot 500. In one example, the knot comprises an overhand knot.

Figure 8:
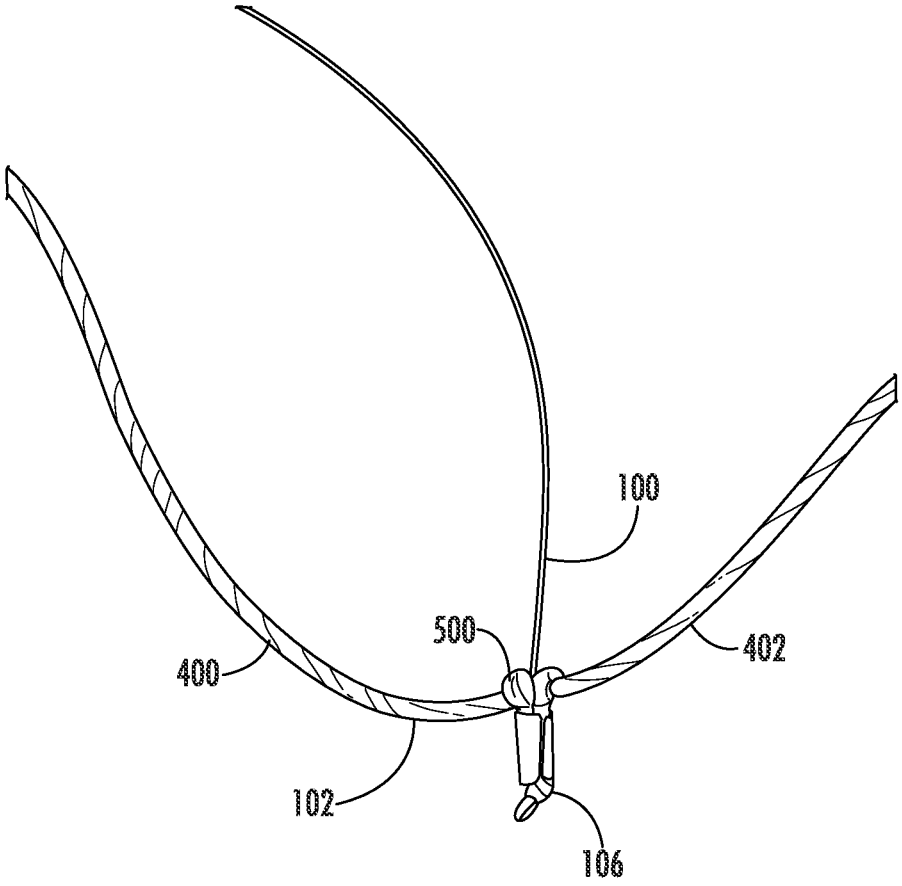
FIG. 8 is an image illustrating the knot of FIG. 7 after tightening.
Figure 9:
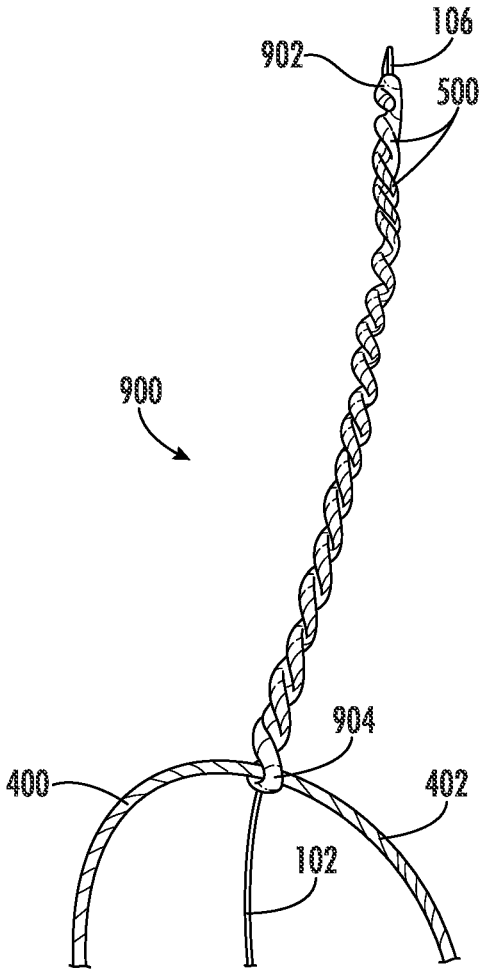
FIG. 9 is an image illustrating an ornamental article formed using a plurality of the knots illustrated in FIG. 8.

FIG. 8 illustrates the results of tightening knot 500 in FIG. 7 around metal wire 100. FIG. 9 illustrates the results of forming plural knots 500 using the method illustrated in FIGS. 7 and 8 to form an elongate member 900 with first and second ends 902 and 904.

Figure 10:
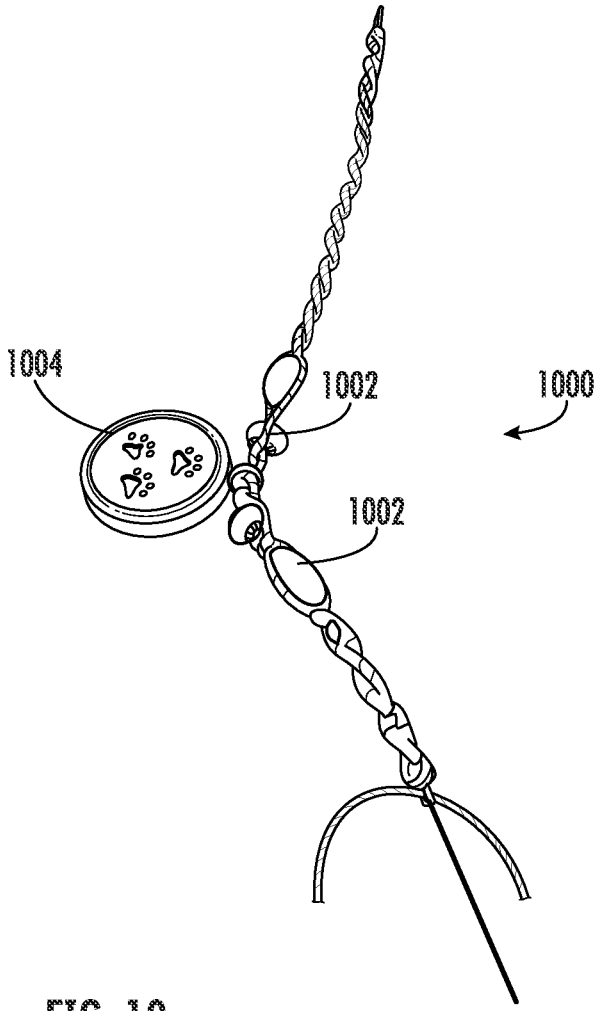
FIG. 10 is an image illustrating an ornamental article formed using hemp fiber with a pendant and beads incorporated in the article.

FIG. 10 illustrates an ornamental article 1000 with beads 1002 and a pendant 1004 incorporated in the article. In FIG. 10, in some cases, the knots are formed around beads 1002, and in other cases, the organic twine material 102 can extend through beads 1002 or other articles incorporated into ornamental article 1000. Because the illustrated example includes only a single strand of wire and only two ends of organic twine material are used, smaller articles can be incorporated into the ornamental article.

Figure 11:
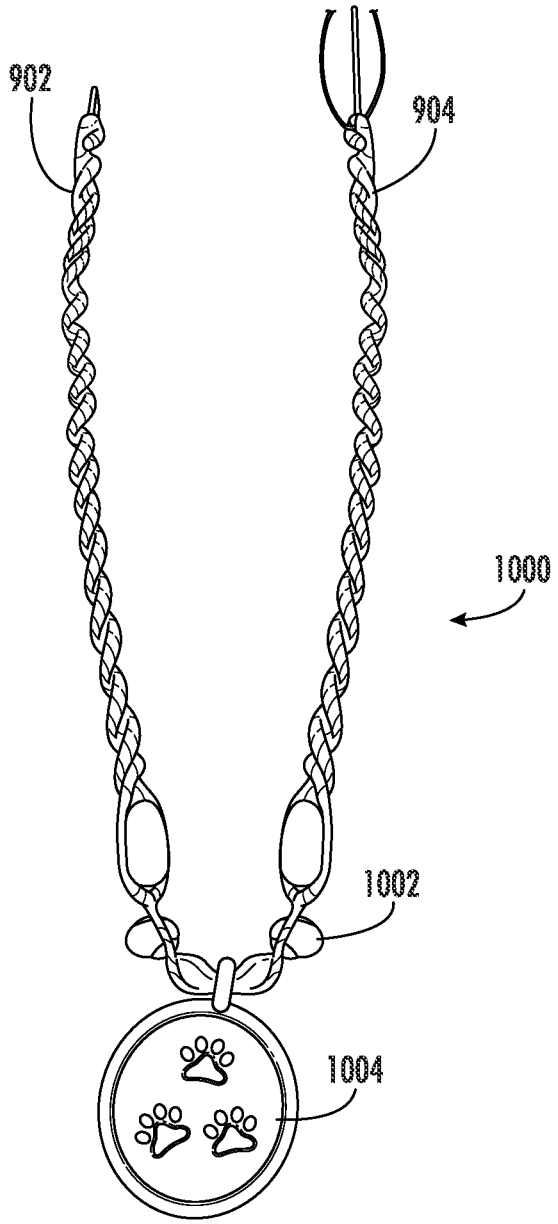
FIG. 11 illustrates the ornamental article of FIG. 10 prior to incorporating the jump rings and clasp onto the ends.

FIG. 11 illustrates a close-up view of ornamental article 1000 with pendant 1004 and beads 1002 incorporated between ends 902 and 904 of ornamental article 1000.

Figure 12:
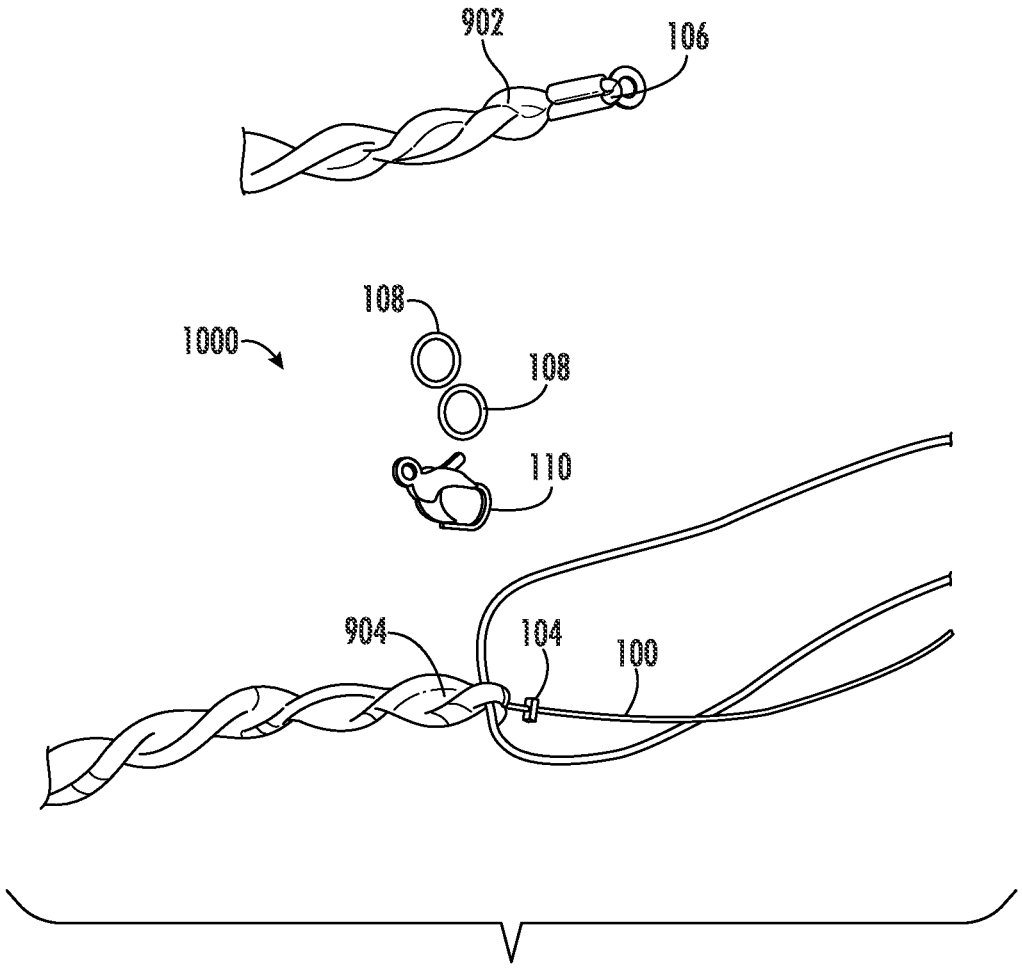
FIG. 12 is a close up view of the jump rings and the clasp.

FIG. 12 illustrates ends 902 and 904 of ornamental article 1000 with jump rings 108 and clasp 110. Ornamental article 1000 also includes a bead crimp 104 as with the first end.

Figure 13:
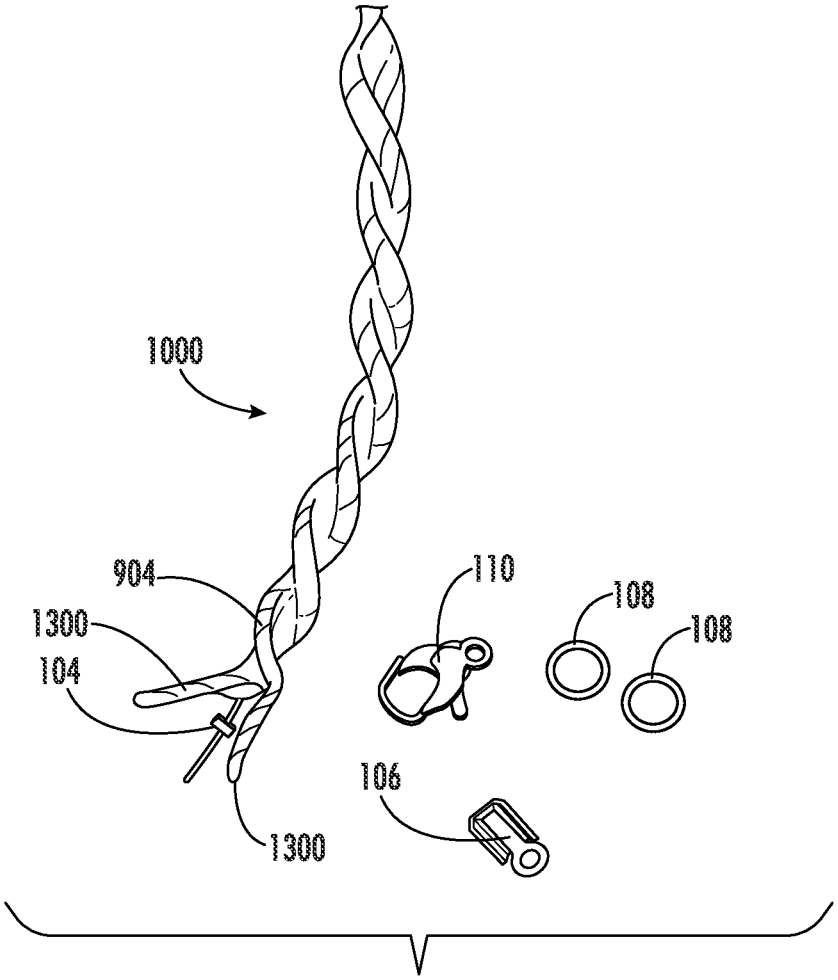
FIG. 13 is an image illustrating one end of the ornamental article, the jump rings, and the clasp.

In FIG. 13, a fold-over crimp connector 106 for enclosing the sleeve crimp connector 104 and ends 1300 of the organic twine material are illustrated.

Figure 14:
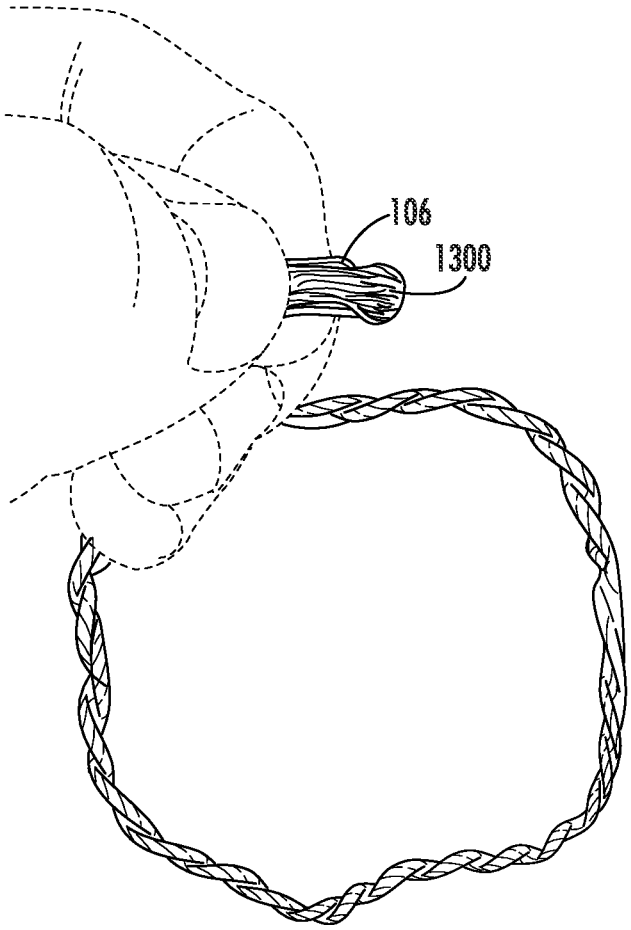
FIG. 14 is an image illustrating the incorporation of a fold-over crimp connector around the sleeve crimp connector on one end of the ornamental article.

FIG. 14 illustrates the insertion of the ends 1300 of the organic twine material, the wire (not visible in FIG. 14), and the bead clamp (not visible in FIG. 14 into the fold-over crimp connector 106.

Figure 15:
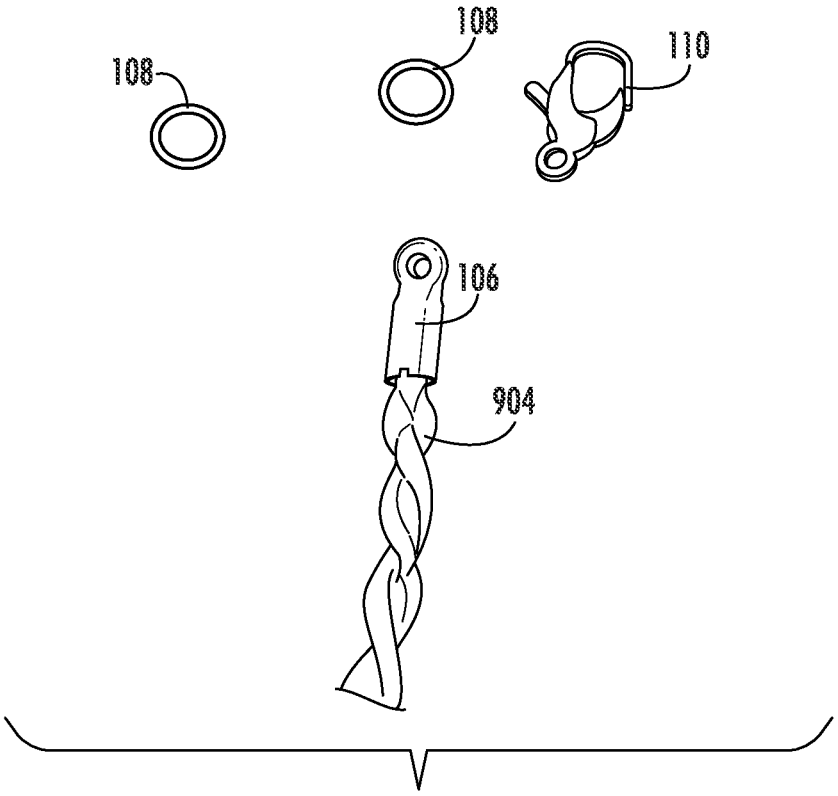
FIG. 15 is an image illustrating the crimp connector of FIG. 14 after the connector has been crimped.

FIG. 15 illustrates the results of crimping the fold-over crimp connector 106 around the bead crimp, the wire, and the ends of the organic twine material on end 904 of ornamental article 1000. FIG. 15 also illustrates jump rings 108 and clasp 110.

Figure 16:
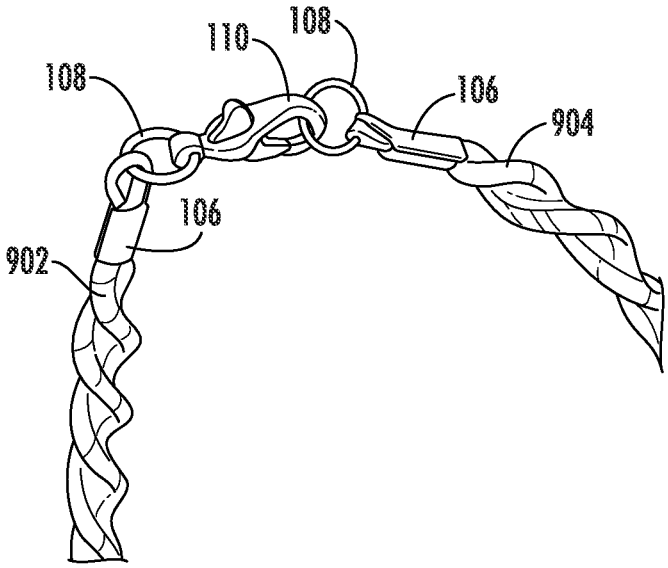
FIG. 16 is an image illustrating the incorporation of the jump rings and the clasp to join the two ends of the ornamental article together.

FIG. 16 illustrates the incorporation of jump rings 108 on fold-over connectors 106 on ends 902 and 904 of ornamental article 1000 and the connection jump rings 108 with a clasp 110.

Figure 17:
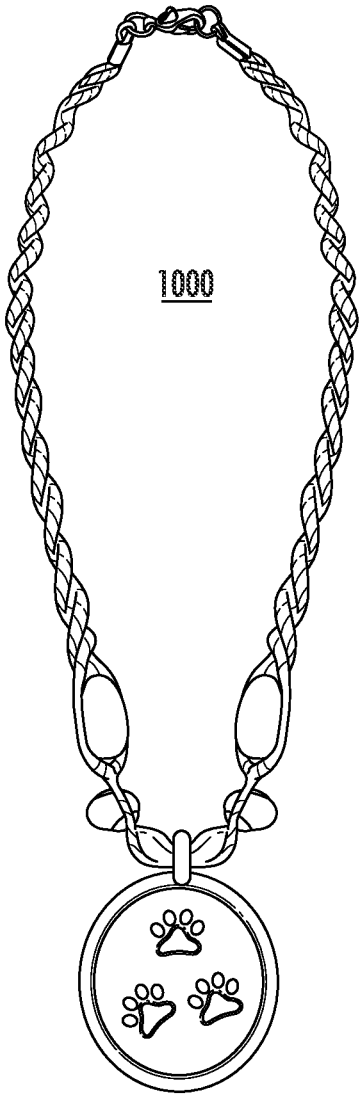
FIG. 17 is an image illustrating the completed ornamental article with clasps, pendant, and beads incorporated in the article.

FIG. 17 illustrates the complete ornamental article 1000, which in the illustrated example is a necklace. It is understood that the same process could be used to make a bracelet or any other ornamental article made of a loop of knotted twine.

Figure 18:
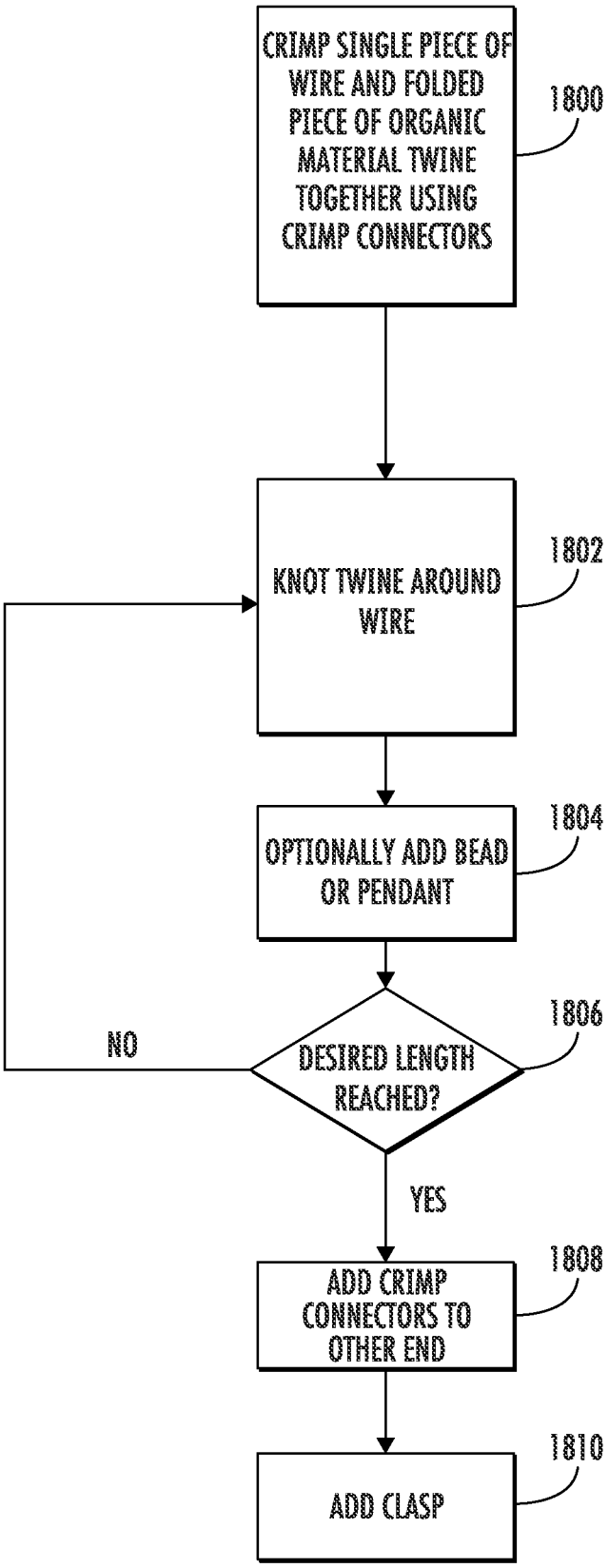
FIG. 18 is a flow chart illustrating an exemplary process for making an ornamental article from an organic twine material.

FIG. 18 is a flow chart illustrating an exemplary process for manufacturing an ornamental article of ornamental twine material. Referring to FIG. 18, in step 1800, the method includes crimping a single piece of wire and a folded piece of organic material twine together using crimp connectors. For example, as illustrated in FIGS. 1-5, a first crimp connector 104 may be crimped onto metal wire 100. A second crimp connector 106 may be crimped around first crimped connector 104, metal wire 100, and a fold or loop of organic material twine 102.

In step 1802, the process includes knotting the twine around the wire. For example, as illustrated in FIGS. 6-9, organic material twine 102 may be knotted around metal wire 100 to produce an elongate member 900 with first and second ends 902 and 904.

In step 1804, beads or pendants are optionally added. For example, as illustrated in FIGS. 10 and 11, beads 1002 and/or pendants 1004 may be added to ornamental article 1000 by passing metal wire 100 through the central aperture in the beads 1002 or pendant 1004. Depending on the size of the central aperture, the organic twine material 102 may be passed through the central aperture in the beads 1002 or pendant 1004 or knotted around the beads 1002 or pendant 1004.

In step 1806, it is determined whether a desired length for the ornamental article has been reached. For example, the jeweler may determine whether the ornamental article has reached the desired length for a necklace or bracelet. If the desired length has not be reached, control returns to steps 1802 and 1804 where additional knots, beads, and/or pendants are added.

Once the desired length has been reached, control proceeds to step 1808 where crimp connectors are added to end 904 of ornamental article 1000. For example, as illustrated in FIGS. 12-14, two crimp connectors 104 and 106 may be crimped onto end 904 of ornamental article 1000 in a manner similar to the crimping of the connectors on end 902.

Once the crimp connectors are added to end 904 of ornamental article 1000, control proceeds to step 1810, where a clasp is added to the ornamental article. For example, as illustrated in FIG. 16, clasp 110 may be connected to end 902 using a jump ring 108, and a second jump ring 108 may be connected to end 904 for attachment with the operational end of clasp 110. In the illustrated example, a lobster clasp is used. However, other types of clasps may be used without departing from the scope of the subject matter described herein.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. An ornamental article comprising:

a single piece of metal wire;

a single piece of organic fiber twine knotted around the metal wire to produce an elongate member with first and second ends;

at least one crimp connector located on at least one of the first and second ends, wherein the at least one crimp connector comprises, on each of the first and second ends, a first crimp connector crimped around the single piece of metal wire and a second connector crimped around the first crimp connector; and a clasp located on one of the first and second ends for connecting to the other of the first and second ends.

2. The ornamental article of claim 1 wherein the metal wire comprises a bead wire.

3. The ornamental article of claim 1 wherein the organic fiber twine comprises hemp fiber twine.

4. The ornamental article of claim 1 wherein the first crimp connector comprises a sleeve crimp connector and the second crimp connector comprises a fold-over crimp connector.

5. The ornamental article of claim 4 wherein fold-over crimp connector is crimped around and encloses at least a portion of the single piece of organic fiber twine.

6. The ornamental article of claim 1 wherein the clasp comprises a lobster clasp.

7. The ornamental article of claim 1 comprising at least one bead located on the elongate member between the first and second ends, where the bead includes an aperture and the single piece of wire extends through the aperture.

8. The ornamental article of claim 7 wherein the organic fiber twine is knotted around the at least one bead.

9. An ornamental article comprising:

a single piece of metal wire;

a single piece of organic fiber twine knotted around the metal wire to produce an elongate member with first and second ends;

at least one crimp connector located on at least one of the first and second ends;

a clasp located on one of the first and second ends for connecting to the other of the first and second ends; and at least one bead located on the elongate member between the first and second ends, where the bead includes an aperture and the single piece of wire extends through the aperture wherein the organic fiber twine extends through the aperture in the at least one bead.

10. A method for making ornamental article, the method comprising:

providing a single piece of metal wire;

knotting a single piece of organic fiber twine knotted around the metal wire to produce an elongate member with first and second ends;

crimping at least one of the first and second ends of the elongate member with at least one crimp connector, wherein crimping at least one of the first and second ends includes crimping a first crimp connector around the single piece of metal wire and crimping a second crimp connector crimped around the first crimp connector; and attaching a clasp to one of the first and second ends for connecting to the other of the first and second ends.

11. The method of claim 10 wherein the metal wire comprises a bead wire.

12. The method of claim 10 wherein the organic fiber twine comprises hemp fiber twine.

13. The method of claim 10 wherein the first crimp connector comprises a sleeve crimp connector and the second crimp connector comprises a fold-over crimp connector.

14. The method of claim 13 wherein the fold-over connector is crimped around and encloses at least a portion of the single piece of organic fiber twine.

15. The method of claim 10 wherein the clasp comprises a lobster clasp.

16. The method of claim 10 comprising incorporating at least one bead onto the elongate member between the first and second ends, where the at least one bead includes an aperture and the single piece of wire extends through the aperture.

17. The method of claim 16 wherein incorporating the at least one bead onto the elongate member includes knotting the organic fiber around the at least one bead.

18. The method of claim 16 wherein incorporating the at least one bead onto the elongate member includes passing the organic fiber twine through the aperture in the at least one bead.

* * * * *